US007419410B2

(12) United States Patent
Myer et al.

(10) Patent No.: US 7,419,410 B2
(45) Date of Patent: Sep. 2, 2008

(54) SEALED ORIENTATION FEATURE FOR A TERMINAL

(75) Inventors: John Mark Myer, Millersville, PA (US); Hurley Chester Moll, Hershey, PA (US); Forrest Irving Kinsey, Jr., Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 2 days.

(21) Appl. No.: 11/701,837

(22) Filed: Feb. 2, 2007

(65) Prior Publication Data

US 2008/0188144 A1 Aug. 7, 2008

(51) Int. Cl.
*H01R 13/11* (2006.01)

(52) U.S. Cl. ..... 439/852

(58) Field of Classification Search ..... 439/839–869, 439/752.5

See application file for complete search history.

(56) References Cited

U.S. PATENT DOCUMENTS

| | | | | |
|---|---|---|---|---|
| 4,850,904 | A * | 7/1989 | Shimizu | 439/856 |
| 5,281,175 | A * | 1/1994 | Chupak et al. | 439/839 |
| 5,443,592 | A * | 8/1995 | Ittah et al. | 439/851 |
| 6,062,918 | A * | 5/2000 | Myer et al. | 439/839 |
| 6,672,910 | B2 | 1/2004 | Hotea | |
| 6,905,376 | B2 * | 6/2005 | Chen | 439/852 |
| 6,945,830 | B2 * | 9/2005 | Copper et al. | 439/852 |

* cited by examiner

*Primary Examiner*—Briggitte R Hammond

(57) ABSTRACT

A terminal having an orientation feature that presents a cut edge in an insertion direction.

7 Claims, 11 Drawing Sheets

SEALED ORIENTATION FEATURE FOR A TERMINAL

BACKGROUND

The disclosure relates to an electrical terminal or contact for use with a mating pin or blade contact to join electrical wires or other electrical conductors together.

It is well known in the art of electrical connectors to provide a receptacle contact or terminal for the receipt of a pin or blade contact where the receptacle terminal has contact beams which extend from a receptacle body and are profiled to electrically engage a pin or blade contact upon insertion thereof. This contact between the receptacle contacts and its corresponding pin or blade contact interconnects the pin and receptacle contacts and results in an electrical connection between the two and their associated terminated conductors.

Multiple different requirements are involved in such an electrical device, particularly when used in a multi-position connector and/or when used in application with specific environmental concerns, for example when used in an automotive connector.

One requirement that may be necessary for multi-position connectors, is that the contact must be capable of sealing. In some cases, a discreet wire seal is crimped to individual contacts around individual wires, and the contact and its associated seal are inserted into an aperture in a connector housing. In other cases a rear seal is provided having a multitude of apertures through which individual contacts are inserted where the contacts are larger than the hole through which they extend, as the holes are nominally provided to sealingly engage the discreet wire to which they are connected.

One electrical receptacle is shown in U.S. Pat. No. 5,791,945 (incorporated herein by reference) where dual beam contacts are provided in a reversely bent sense such that their free ends overlap. The present disclosure provides an orientation feature that may be used on a terminal used with the receptacle of U.S. Pat. No. 5,791,945 and other receptacles. A described embodiment of the orientation feature presents a metal edge that has been cut such that abutment of the cut edge to a seal during introduction of the terminal into a housing does not result in the seal being cut or damaged.

SUMMARY

The present disclosure provides an electrical terminal. The electrical terminal comprises a body portion comprising a lower wall, an upper wall, and side walls connecting the upper and lower walls to define a perimeter of the body. The walls all have a substantially similar thickness. The electrical terminal further comprises an orientation feature having an orientation wall extending beyond the perimeter of the body and presenting a first cut edge in an insertion direction. The orientation wall has a substantially similar thickness to the walls of the body.

In another embodiment of the disclosure, an electrical terminal is provided comprising a body portion having walls defining a perimeter of the body, the walls all having a substantially similar thickness. The terminal further comprises an orientation feature having a orientation wall extending beyond the perimeter of the body and presenting a first cut edge in an insertion direction, the orientation wall having a substantially similar thickness to the walls of the body, the cut edge being tapered and coined.

In another embodiment of the disclosure, an electrical terminal housing configured to be coupled to a wire seal is provided. The housing comprises a plurality of cavities, each cavity including a cut-away portion sized and shaped for receiving, through the wire seal, an orientation feature of an electrical terminal that presents a cut edge in an insertion direction.

DETAILED DESCRIPTION OF THE DRAWINGS

Figure 1:
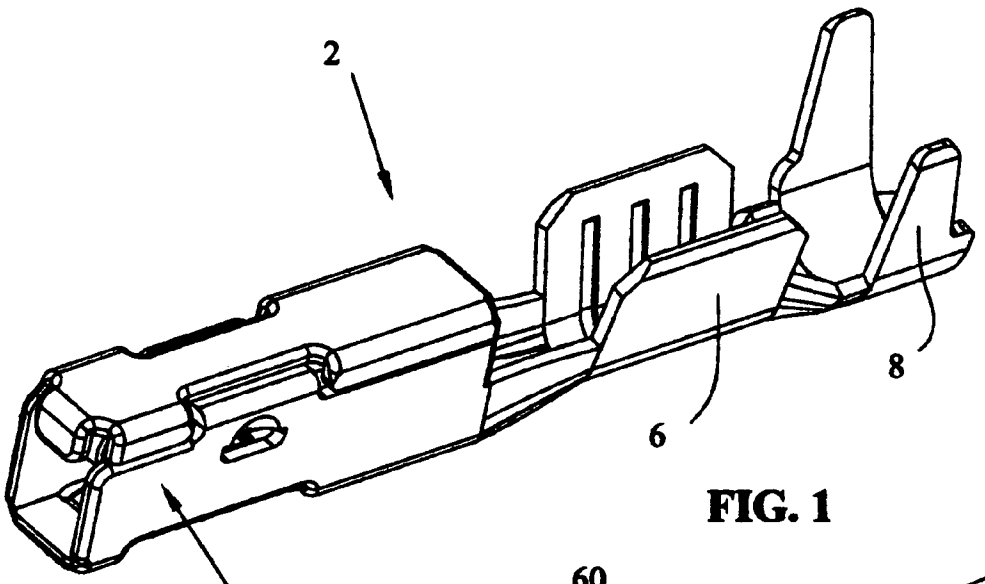
FIG. 1 is a front perspective view of the electrical receptacle terminal of the present invention.
Figure 2:
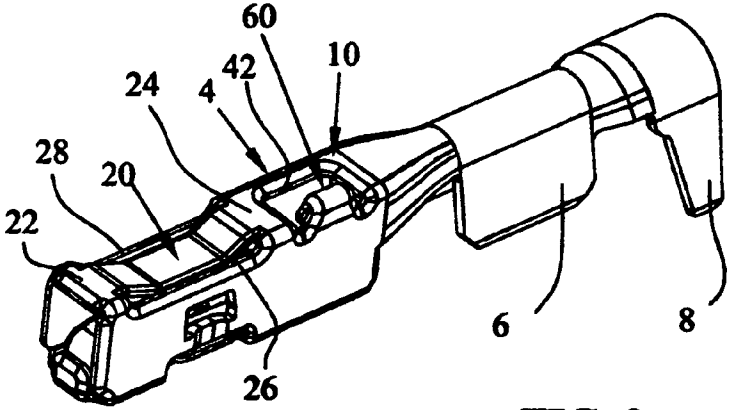
FIG. 2 is a lower perspective view of the terminal shown in FIG. 1.

With respect first to FIGS. 1 and 2, an electrical receptacle terminal is shown at 2 including the receptacle contact portion 4, a wire crimp section at 6 and a strain relief section at 8.

Figure 3:
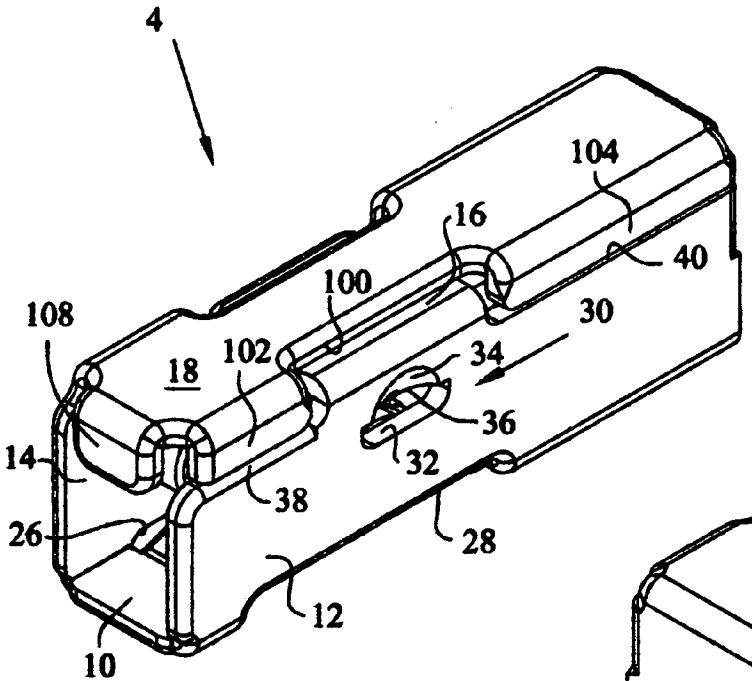
FIGS. 3-6 show various perspective views of the receptacle terminal portion of the terminal.

With respect now to FIGS. 3 through 6, the construction of the receptacle contact portion 4 will be described in greater detail. As shown in FIG. 3, the receptacle contact portion 4 includes a lower wall 10, sidewalls 12, 14, an upper wall 16 and a cover wall 18, which together form a body interior portion. With reference again to FIG. 2, lower wall 10 includes an inwardly directed contact portion 20 defined as a beam extending between wall parts 22 and 24 and having separations at 26, 28. The contact portion 20 is thereafter inwardly directed and can act as a resilient contact extending between the wall parts 22, 24. Lower wall 10 also includes a cut-out 42 which allows orientation feature 60 to be formed as discussed below. It should be appreciated that while the orientation feature 60 and tab 61 are discussed herein, that orientation feature 60' and tab 61', shown in FIG. 10*b*, may be substituted anywhere orientation feature 60 and tab 61 are discussed. Furthermore, while the embodiments of orientation feature 60, 60' are discussed herein as part of a dual beam receptacle terminal 2, other terminals and products are envisioned to be used with orientation feature 60, 60' of the present disclosure.

With reference again to FIG. 3, sidewall 12 is shown including a contact stop portion 30, which will be described herein which includes a lower cut-out portion 32 and an inwardly directed spherically-shaped indentation at 34 defining a lower engagement edge at 36. Alternatively, in some embodiments, contact stop portion 30 is replaced with stop flange 17, shown in FIG. 8. Stop flange 17 performs the same function as stop portion 30. It should be appreciated that some figures depict use of stop portion 30 and the balance depict use of stop flange 17. One skilled in the art would know of yet additional suitable variations. Sidewall 12 further includes a forward recessed section 38 and a rearward recessed section 40. The upper wall 16 itself extends integrally from sidewall 12, and both the forward 38 and rearward 40 recessed sections are recessed from the upper wall 16, as will be discussed further herein.

Figure 4:
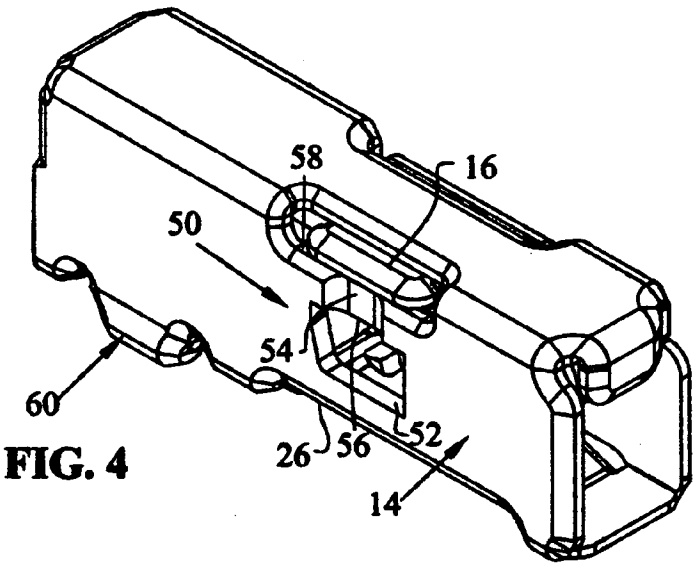
Figure 5:
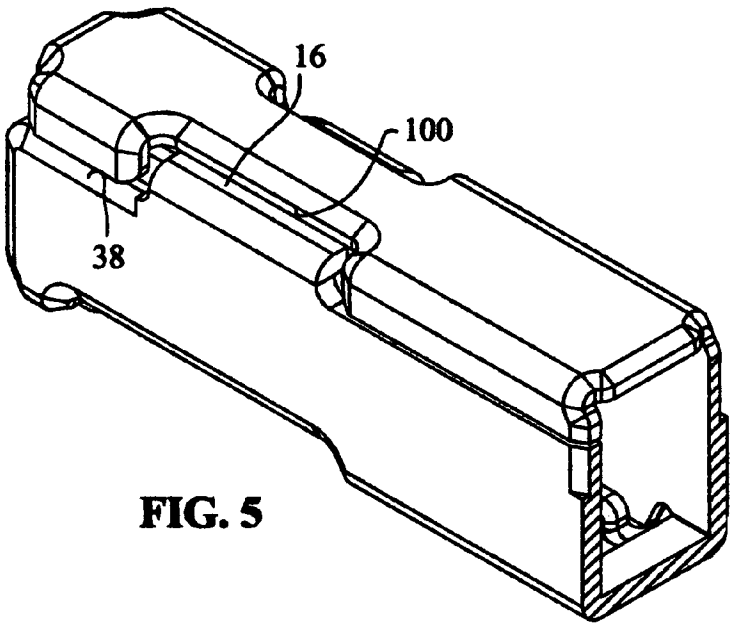
Figure 16:
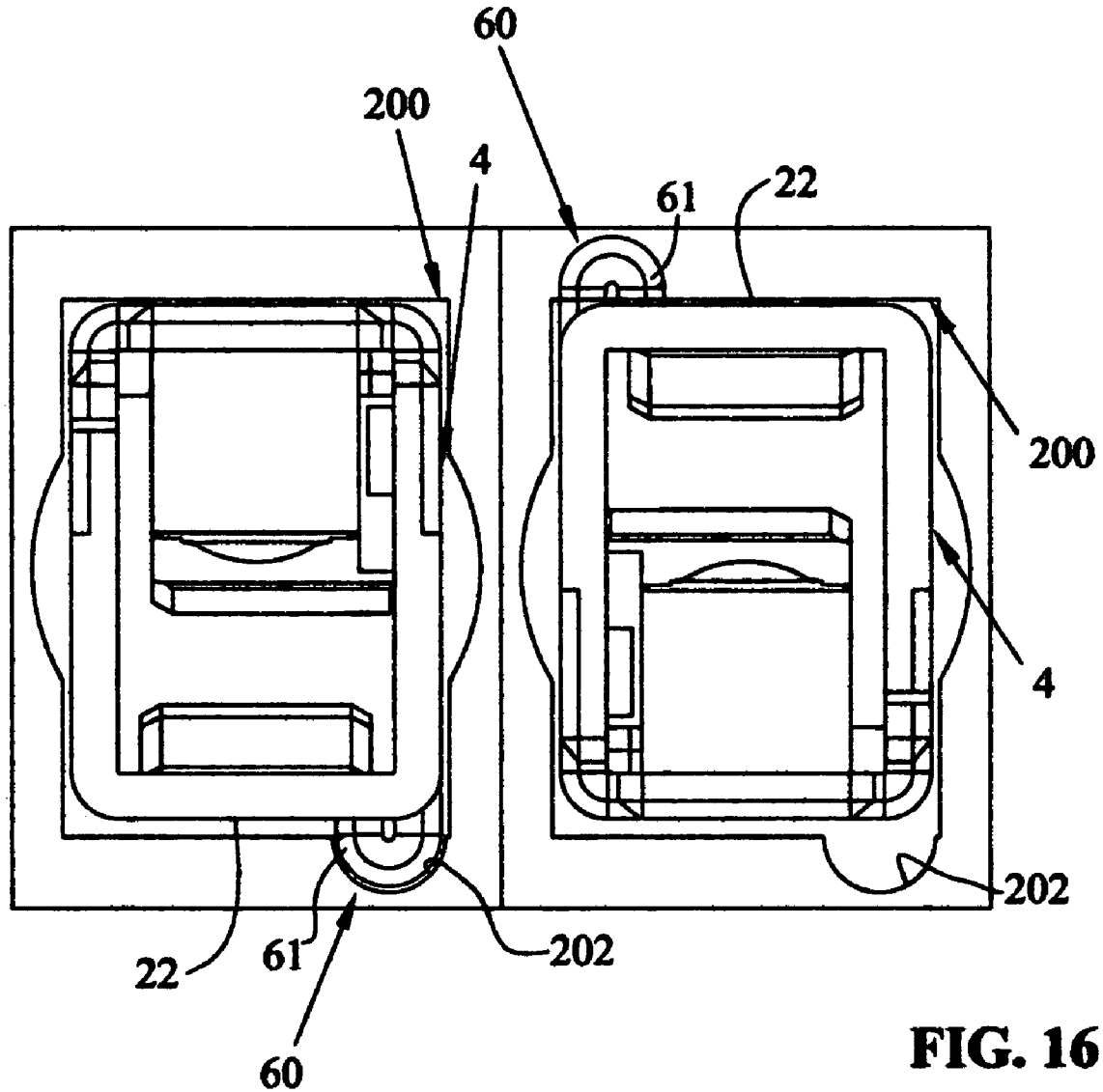
FIG. 16 shows an overhead view of two of the receptacle terminals of FIG. 1.

With reference now to FIG. 4, sidewall 14 includes a contact stop-portion 50 including a cut-out portion 52 and a strap portion at 54 extending above the cut-out portion 52 and inwardly directed to define a lower engagement edge 56. Sidewall 14 further includes a recessed section 58, intermediate recessed sections 38, 40 of sidewall 12, as will be further discussed herein. Finally, sidewall 14 also includes an orientation feature 60 for aligning the terminal with a housing cavity 200 (FIG. 16). While orientation feature 60 is described as being part of sidewall 14, feature 60 is formed from metal taken from what would otherwise be part of lower wall 10, as further described below.

The provided embodiment housing (not shown) in which housing cavity 200 is located, when assembled, is coupled to a terminal position assurance member via a peripheral seal on a first end, and to female terminals 2 via a wire seal cover and a wire seal on a second end (not shown).

Figure 17:
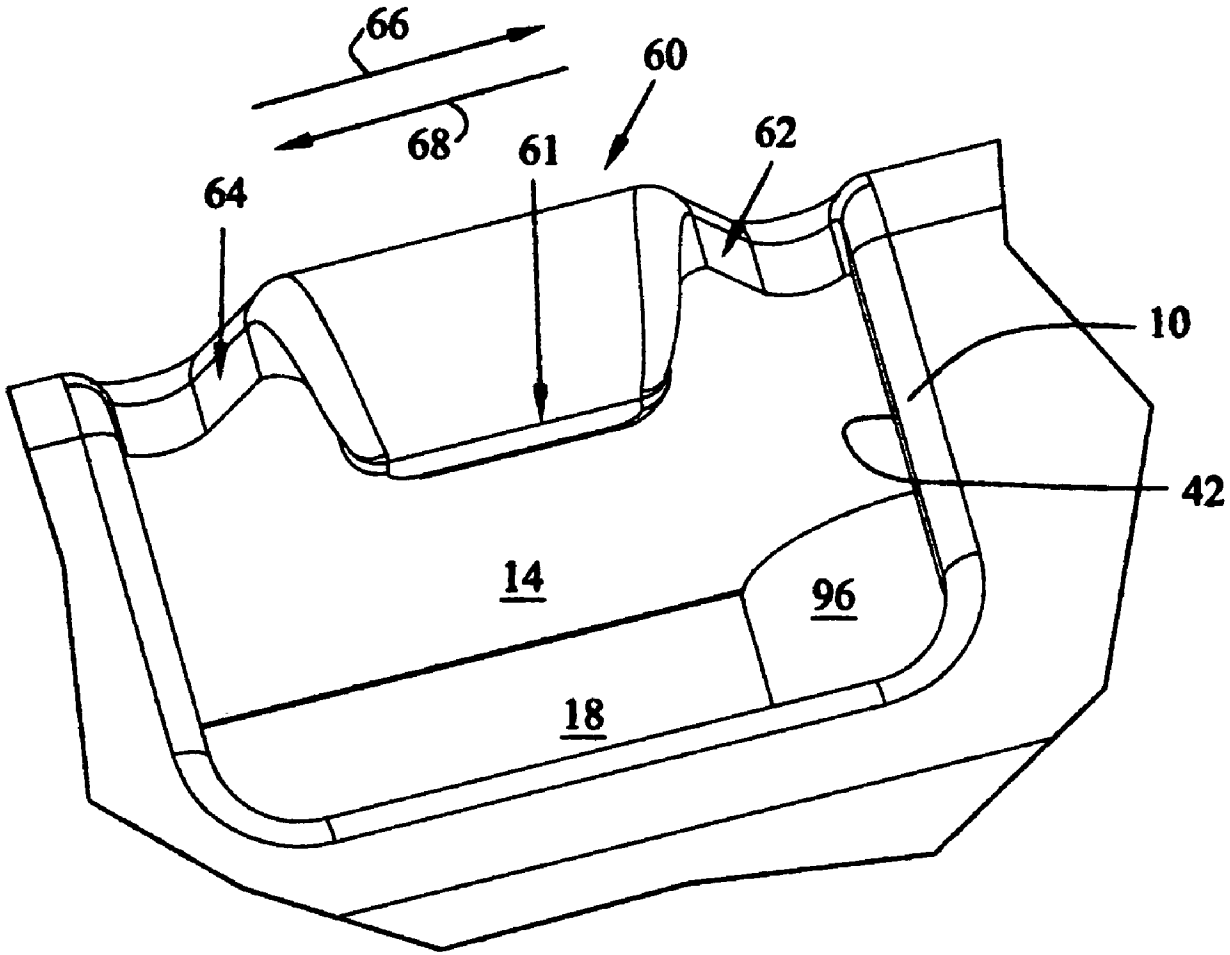
FIG. 17 shows a partial perspective view of the orientation feature of the electrical receptacle terminal of FIG. 1.

In one embodiment, orientation feature 60 is formed as part of sidewall 14 extending beyond lower wall 10 as shown in FIG. 17. Orientation feature 60 is formed from material removed from lower wall 10 to form cut-out 42. When the flat blanks of FIGS. 10*a,b* are bent into shape, orientation feature 60 is kept planar with sidewall 14. Subsequently, tab 61 of orientation feature 60 is bent inwardly to form the arc-shaped or "U"-shaped orientation feature 60. The 180 degree bend provides double stock thickness for the formed orientation feature 60. This double stock thickness presents a larger surface area in the insertion direction over which force may be dispersed such that any encountered seal is less likely to be cut thereby. Orientation feature 60 presents a cut edge, that is an edge that has been cut as opposed to an end formed by bending, in both the insertion and extraction direction. Orientation feature 60 includes tapered and coined edges 62, 64 to slip in and out of the seal in the housing during terminal insertion and extraction. Both edges 62, 64 are cut during creation of the flat blank shown in FIG. 10A. Edges 62, 64 are further tapered and coined. Edge 62 presents itself to abut an encountered seal when receptacle terminal 2 is moved in insertion direction 66. Edge 64 presents itself to abut an encountered seal when receptacle terminal 2 is moved in extraction direction 68.

Extending orientation feature 60 below lower wall 10 allows terminals 2 to be packaged on a 2.20 mm pitch as opposed to larger pitches, such as a 2.54 mm pitch, allowed by terminals having a side extending orientation feature, such as those described in U.S. patent application Ser. No. 11/186,436, which is incorporated herein by reference. More generally, extending orientation feature 60 below lower wall 10 allows a tighter lateral packing of terminals 2 of any size, relative to the lateral packing allowed by lateral orientation features for similarly sized terminals. Alternatively, extending orientation feature 60 below lower wall 10 allows terminals 2 to be packaged at pitches larger than 2.20 mm, but with larger wires and increased sidewall cutout portions in the housing to accommodate the larger wires than terminals with lateral orientation features. More generally, for a given pitch, extending orientation feature 60 below lower wall 10 allows a larger wire to be used relative to the size of wire permitted by laterally positioned orientation features. Nonetheless, it is envisioned to have terminals 2 with both lateral and longitudinal orientation features.

FIG. 16 shows two terminals 2 being mounted in housing cavity 200. Each housing cavity 200 includes a cut-away portion 202 in the lower right corner. The left terminal 2 is properly oriented such that orientation feature 60 is aligned with cut-away portion 202. The right terminal 2 is improperly oriented such that orientation feature 60 prevents the improper insertion.

Figure 6:
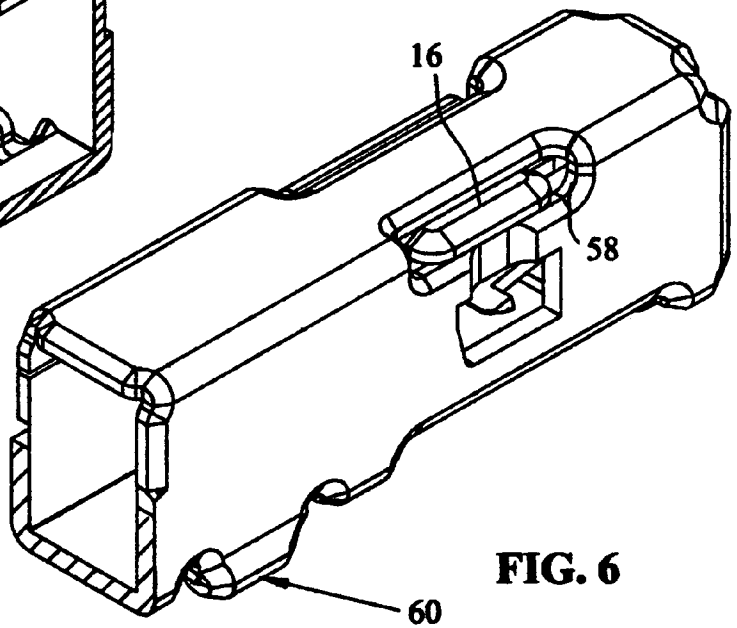
Figure 7:
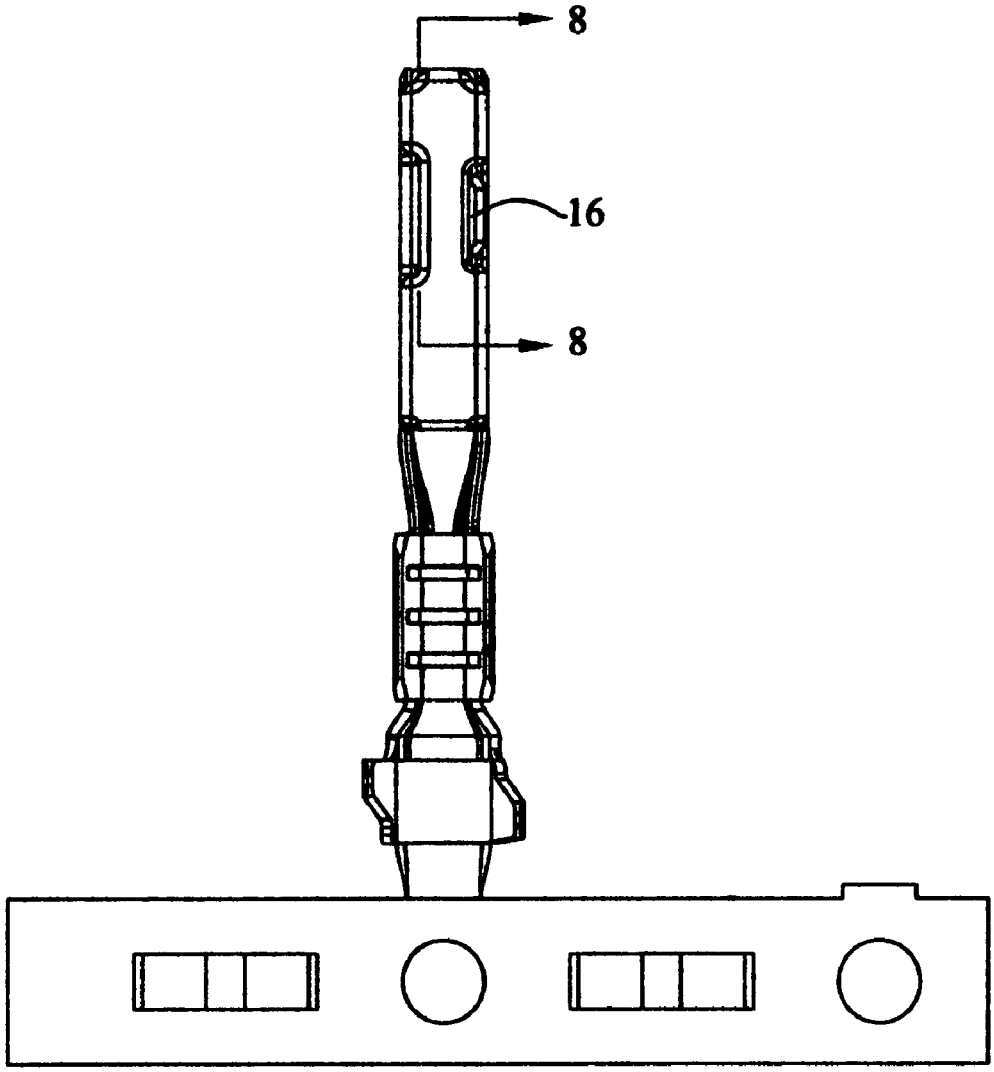
FIG. 7 is a top plan view of the terminal of FIG. 1, with the terminal connected to the carrier strip.
Figure 8:
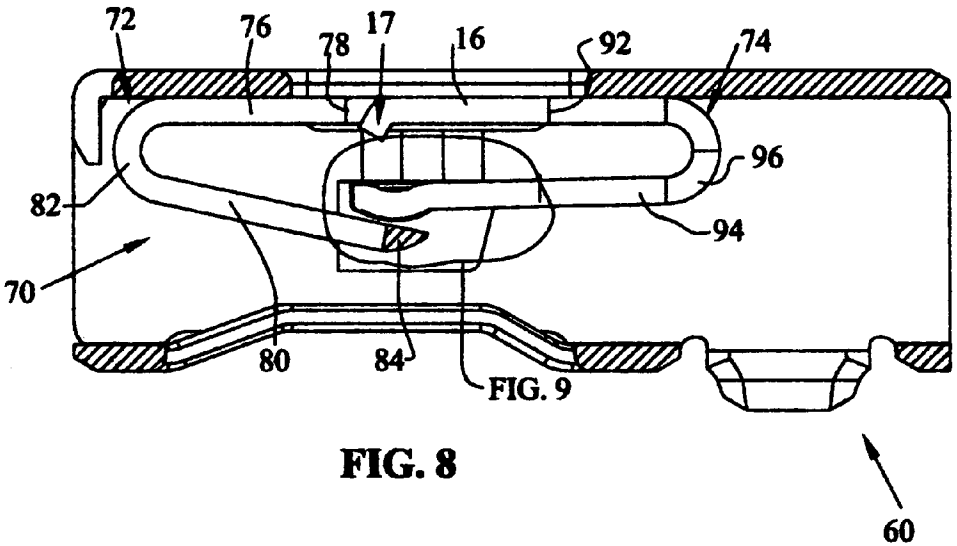
FIG. 8 is a cross-sectional view shown through lines 8-8 of FIG. 7.

With reference now to FIGS. 3 through 7, upper wall 16 is shown spanning between sidewalls 12 and 14 and integrally connected to sidewall 12. As shown in FIGS. 4, 6, and 7, upper wall 16 is shown received in recessed section 58 of sidewall 14. With reference now to FIG. 8, upper wall 16 is shown in section yet includes a contact assembly 70 extending integrally from upper wall 16 to include a first or primary contact portion 72 and a second or secondary contact portion 74.

With reference still to FIG. 8, first contact portion 72 includes a cantilever portion 76 extending integrally from front edge 78 of upper wall 16. First contact portion 72 further includes a reversely bent portion 80, reversely bent through radiused portion 82. Finally, first contact portion 72 includes extension portions 84 extending on both sides of reversely bent portion 80 to form a T-shaped portion as will be described further herein.

Figure 9:
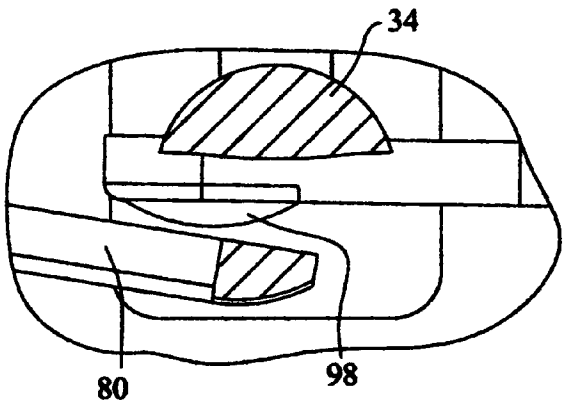
FIG. 9 is an enlarged view of the portion denoted in FIG. 9.

With reference still to FIG. 8, second contact portion 74, includes a cantilevered portion at 90 extending integrally from a rear-edge 92 of upper wall 16 and includes a reversely bent portion 94, reversely bent through radiused portion 96. As best shown in FIG. 9, the free-end of reversely bent portion 94 is crowned, to define a spherically shaped dimple 98 (FIG. 9) positioned over reversely bent portion 80, in the overlapping region of reversely bent portions 80, 94.

With reference again to FIG. 3, cover wall 18 includes a recessed section 100 with downwardly extending lip portions 102, 104 which flank the upper wall 16 and extend into the recessed sections 38 and 40, as described herein. Cover wall 18 further includes a downwardly extending flap 108 to assist in directing a pin on insertion thereof. With the product as described above, the manufacturing of the terminal will now be described with reference to FIG. 12.

Figure 10A:
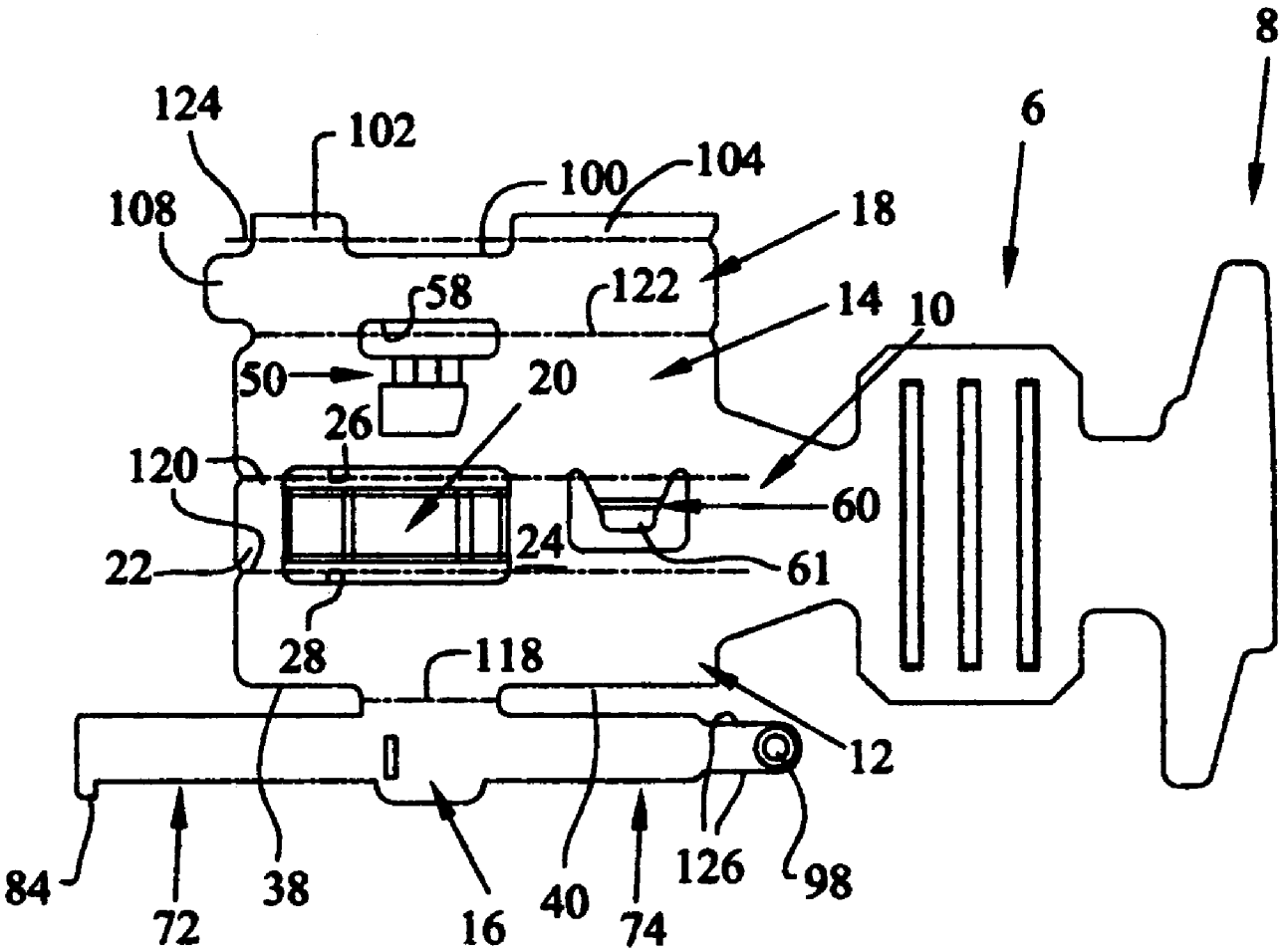
FIGS. 10*a* & *b* show two embodiments of an orientation feature of the receptacle terminal of FIG. 1 in the flat blank condition.
Figure 10B:
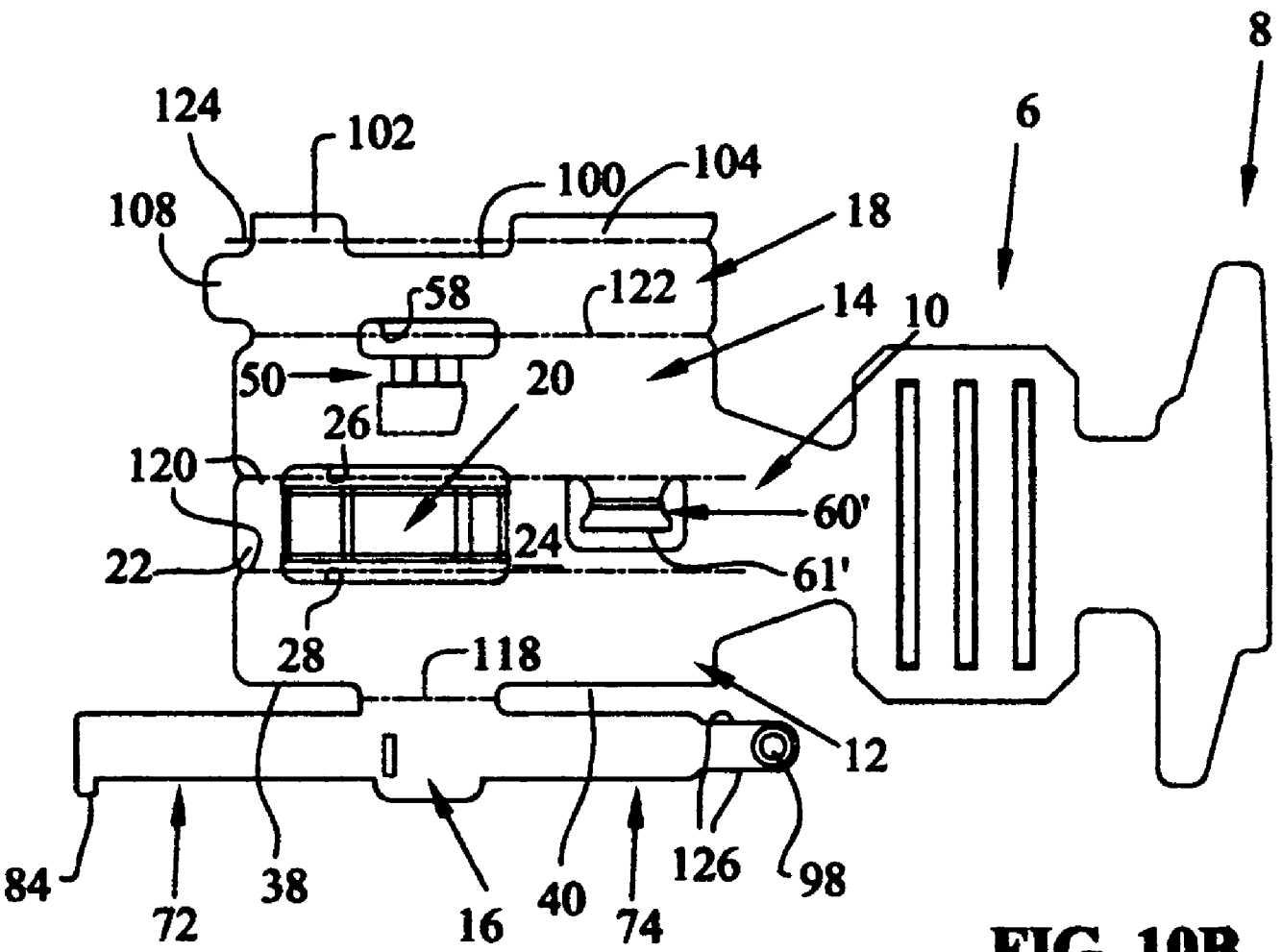

As shown in FIGS. 10*a* and 10*b*, the terminal is shown in a flat blank condition, from the inside surface of the terminal. The blank is stamped to include the shape as shown, and then formed to define such features as the inwardly directed contact portion 20, the stop portions 30, 50, the orientation feature (60 for FIG. 10*a*, 60' for FIG. 10*b*) and the spherically shaped dimple 98. The contact formation would include the reversely bending of contact portions 72 and 74, and then the folding of the terminal into the square receptacle form, by folding the contact portions 72, 74 along lines 118, 120, 122, and 124, and into the configuration of FIGS. 1 and 2. In blank form, the orientation feature 60 approximates a trapezoidal shape and the orientation feature 60' approximates an hourglass shape.

Note that FIG. 10 also provides a good view of some features not seen in the previous views. First, FIG. 10 shows extension portions 84, which are wider than the associated reversely bent portion 80 (FIG. 8) which form a T-shaped portion adjacent the end. Secondly, FIG. 10 shows second contact portion 74 including a necked-down section defined by side edges 126.

With respect to FIGS. 10 through 15, the operation of the receptacle terminal will now be described. It should be appreciated from the previous discussion, that contact assembly 70 together with inwardly directed contact portion 20, together provide opposed contacts for receipt of a pin or other male component.

Figure 13:
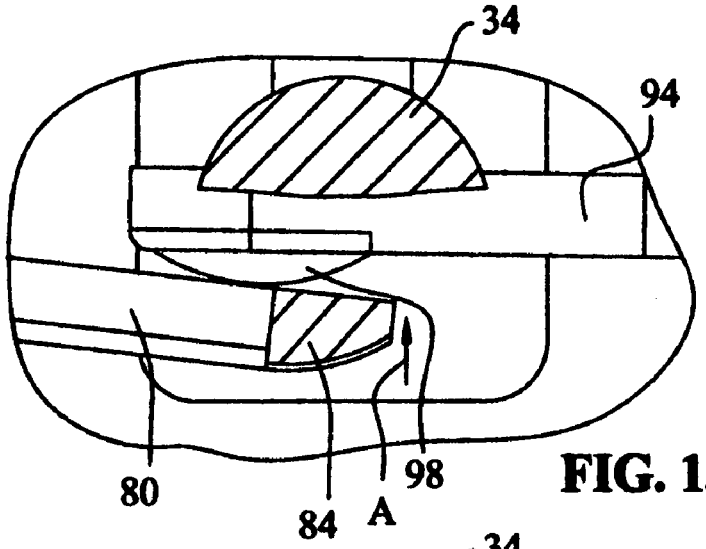
FIG. 13 is a view similar to that of FIG. 9 showing the first and second contact portions in initial contact.

With respect first to FIG. 13, as a pin is first inserted, reversely bent portion 80 begins to rotate in the counterclockwise sense as viewed in FIG. 13 (see arrow A) to the position where the reversely bent portion 80 contacts the spherically shaped dimple 98. Up until this point, it should be appreciated that the first contact portion 72 and more particularly, the reversely bent portion 80 moves alone. Further insertion of the pin, as shown in FIG. 14, causes the two reversely bent portions 80, 94 to travel together, also causing the reversely bent portion 80 to pivot around the spherically shaped dimple 98.

Figure 12:
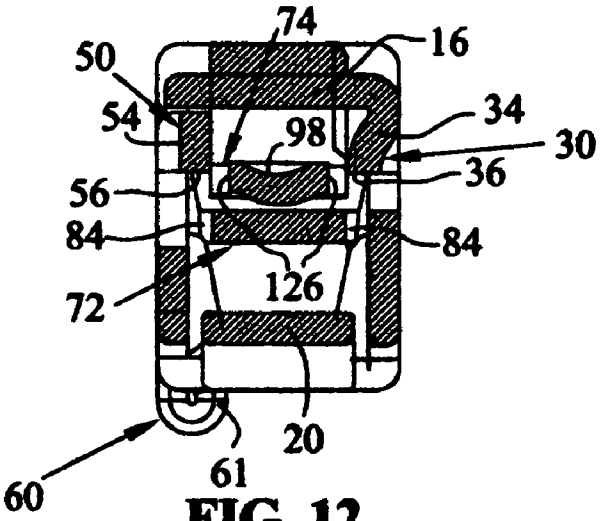
FIG. 12 shows a cross sectional view through lines 12-12 of FIG. 11.
Figure 11:
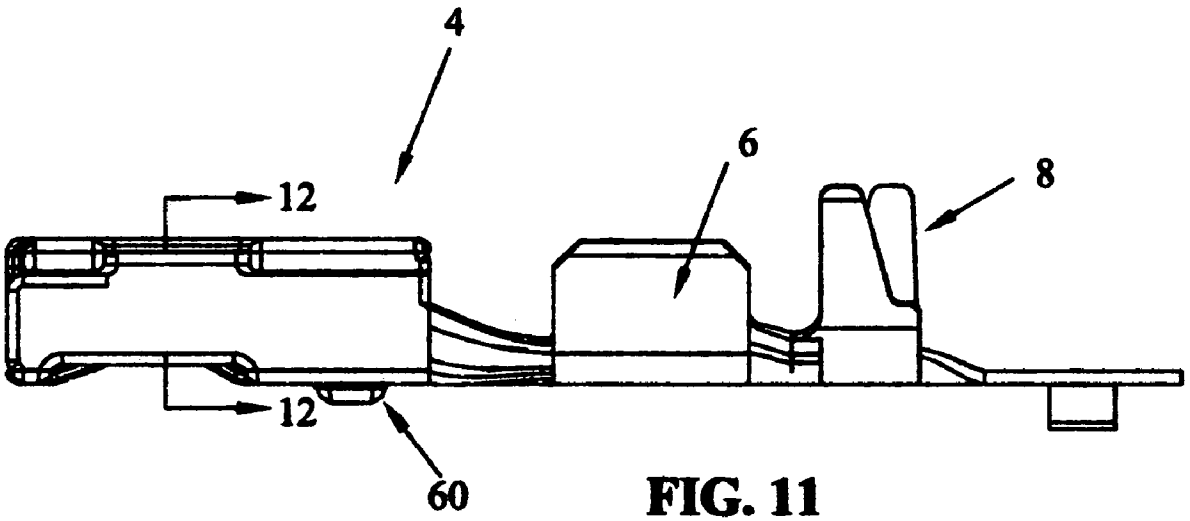
FIG. 11 shows a side view of the terminal of FIG. 7.

Furthermore, the reversely bent contact portion 94, passes through the contact stop portions 30, 50. This is due to the necked down surfaces 126 discussed with reference to FIG. 10. This is shown in cross section in FIG. 12, where the surfaces 126 are shown being received between the contact stop portions 30, 50. As shown in FIG. 12, the necked-down section defined by surfaces 126 allow second contact portion 74 to be positioned intermediate indentations 34 and 54.

Figure 15:
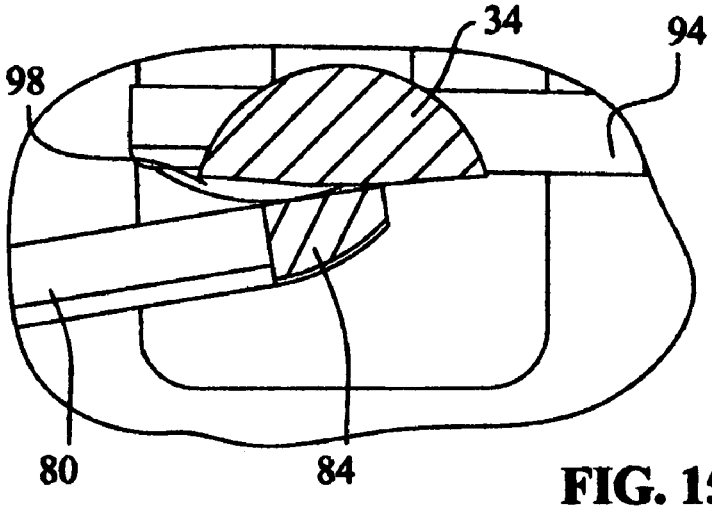
FIG. 15 shows the first and second contact portions moved to their extreme position.

Rather, extension portions 84 of reversely bent portion 80, are defined wider than engagement edges 36, 56, (again seen in FIG. 12) and therefore will contact the engagement edges 36, 56 upon upward biasing of first contact portion 72 to that point. FIG. 15 also shows the two reversely bent portions 80, 94 in their final position, where extension portions 84 contact the engagement edges 36 of stop portion 30.

Figure 14:
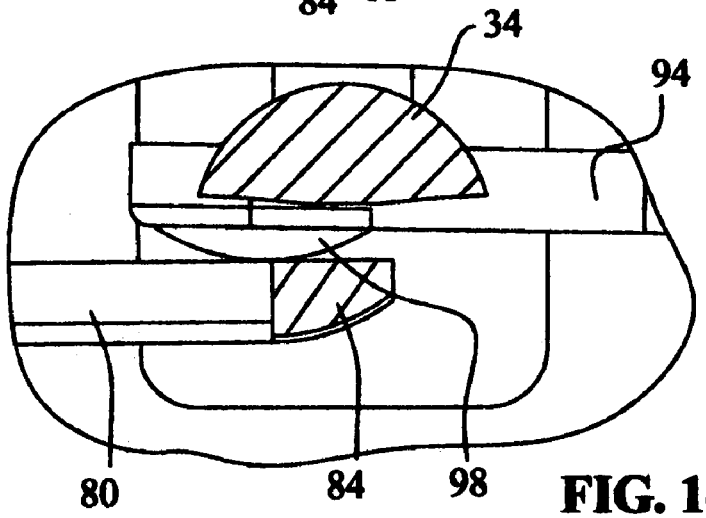
FIG. 14 shows the movement of the first and second contact portions into an intermediate position prior to their stop position.

It should also be noted that during the progression from FIGS. 13 to 15, reversely bent portion 80 pivots around spherically shaped dimple 98 preventing the arms from engaging in a back-to-back parallel manner. This prevents spiking in the insertion force during the insertion of the contact pin. Also as the stop portions 30, 50 are provided on the side walls, the vertical positioning of the engagement edges 36, 56 is more precisely defined. Having the overstress feature extend from the side walls prevents any problems with dimensional stack up, because the tolerances of the receptacle "box" shape/dimensions, and the various metal thicknesses are not at issue and therefore do not accumulate. Also as viewed in FIG. 8, the cantilevered beam portions 76, 90 extend from the upper wall 16 and can also move upon resilient movement of reversely bent portions 80, 94 further reducing the stresses in the contact assembly 70. Finally, and with reference again to FIG. 3, the receptacle contact portion 4 is defined with a clean body for insertion through a seal. As lips 102, 104 extend downwardly into the associated recesses, 38, 40, no sheared edge is positioned where it may cut a seal during the insertion of the contact through the seal.

What is claimed is:

1. An electrical terminal comprising: a body portion comprising a lower wall, an upper wall, and side walls connecting the upper and lower walls to define a perimeter of the body portion, the walls all having a substantially similar thickness; and an orientation feature having an orientation wall extending beyond the perimeter of the body portion and presenting a first cut edge in an insertion direction and a second cut edge in an extraction direction, the orientation wall having a substantially similar thickness to the walls of the body portion, wherein the first and second cut edges being coined and the orientation feature being formed from material removed from the lower wall.

2. The electrical terminal of claim 1, wherein the orientation feature is tapered.

3. The electrical terminal of claim 1, wherein the orientation wall is bent 180 degrees to form a "U" shape when viewed in the insertion direction.

4. The electrical terminal of claim 1, wherein the orientation feature presents a trapezoidal shape prior to being bent when viewed from the side.

5. The electrical terminal of claim 1, wherein the orientation feature is integral with a sidewall and extends beyond the lower wall.

6. The electrical terminal of claim 1, wherein the orientation wall is integral with the body portion.

7. The electrical terminal of claim 1, wherein the orientation feature is integral with a sidewall, extends beyond the lower wall, and a portion of the orientation feature is coplanar with a sidewall.

* * * * *